United States Patent [19]

Dial

[11] Patent Number: 4,915,195

[45] Date of Patent: Apr. 10, 1990

[54] APPARATUS FOR LUBRICATING RAILROAD VEHICLE WHEEL FLANGES

[76] Inventor: Darrell D. Dial, 11255 Hwy. 80 W., Ste. 105, Aledo, Tex. 76008

[21] Appl. No.: 167,027

[22] Filed: Mar. 11, 1988

[51] Int. Cl.[4] ..... B61K 3/00

[52] U.S. Cl. ..... 184/3.2; 184/99

[58] Field of Search ..... 184/3.2, 99, 3.1; 188/264 B

[56] References Cited

U.S. PATENT DOCUMENTS

| | | | |
|---|---|---|---|
| 322,994 | 6/1885 | Clarkson . | |
| 934,425 | 8/1909 | Callahan . | |
| 990,034 | 6/1911 | Conniff . | |
| 990,637 | 4/1911 | Dawson | 184/99 |
| 1,017,015 | 6/1912 | Perkins . | |
| 1,025,916 | 7/1912 | Kincaid . | |
| 1,027,559 | 5/1912 | Miner | 184/3.2 |
| 1,033,919 | 7/1912 | Miner | 184/3.2 |
| 1,043,141 | 11/1912 | Plymale | 184/3.2 |
| 1,092,738 | 4/1914 | Miner | 184/3.2 |
| 1,196,509 | 8/1916 | Black | 184/3.2 |
| 1,222,341 | 4/1917 | Wholey | 184/3.2 |
| 1,438,026 | 12/1922 | Eichelberger | 184/99 |
| 1,503,174 | 2/1925 | Vincent . | |
| 1,753,410 | 4/1930 | Grismore . | |
| 1,780,464 | 11/1930 | Coppage | 184/3.2 |
| 1,972,371 | 9/1934 | Bonnifield . | |
| 2,489,442 | 11/1949 | Whiting . | |
| 2,580,687 | 1/1952 | McMillan . | |
| 2,589,582 | 3/1952 | Strughold et al. . | |
| 2,637,411 | 5/1953 | Harbison . | |
| 2,727,589 | 12/1955 | Campney . | |
| 2,800,198 | 7/1957 | Jones et al. . | |
| 2,866,521 | 12/1958 | Gibson . | |
| 2,903,090 | 9/1959 | Brown et al. . | |
| 2,946,404 | 7/1960 | O'Neal | 184/3.2 |
| 4,088,078 | 5/1978 | Noble . | |
| 4,485,898 | 12/1984 | Bracken et al. | 188/264 B |

FOREIGN PATENT DOCUMENTS

| | | | |
|---|---|---|---|
| 272723 | 3/1930 | Italy | 188/264 B |
| 624614 | 6/1949 | United Kingdom | 188/264 B |

*Primary Examiner*—Donald E. Stout
*Attorney, Agent, or Firm*—James E. Bradley

[57] ABSTRACT

An apparatus for applying lubricant to a railroad vehicle wheel flange utilizes a solid lubricant material. The block of lubricant is wedge-shaped and mounts to one side of the brake shoe. The lubricant wedges between the wheel flange and the brake shoe. The block of lubricant is secured to a plate that sandwiches between the brake shoe pads and the beam head of the braking system. A cantilevered, resilient loop urges the block into engagement with the flange.

8 Claims, 4 Drawing Sheets

APPARATUS FOR LUBRICATING RAILROAD VEHICLE WHEEL FLANGES

BACKGROUND OF THE INVENTION

1. Field of the Invention

This invention relates in general to devices for lubricating wheel flanges on railroad vehicles, and in particular to a device that employs a block of solid lubricant.

2. Description of the Prior Art

It has long been known that the friction created between the flange of a railroad vehicle wheel and the rail causes wear. A number of different lubrication systems are available on the market for applying a lubricant to the wheel flange or to the rail to reduce this wear.

All of the known systems currently available employ a liquid lubricant which is sprayed onto the wheel flange or the rail. Some are stationarily mounted beside the track at certain points. Others are mounted on board a railroad vehicle for lubricating the wheel flanges.

Generally, the on board types are fairly expensive and complex in regard to the controls for metering the spray. Because of this, normally, at most only a few of the vehicles in a train will have a lubricant system. The expectation is that the lubricant will rub from the wheel flange onto the rail and carry back to the wheel flanges of the other railroad cars in the train to apply the lubricant. The desired carry back is not always achieved.

Also, these systems have other disadvantages. They require a storage container which has to be refilled with the lubricant. Some of the sprayed lubricant runs onto the rail bed and is spread by rain out into the surrounding area. This is detrimental to the environment. The systems have to be maintained.

A number of patents exist that show a solid lubricant stick which is mounted to various points on the railroad vehicle. To Applicant's knowledge, none of these systems are currently marketed. Improvements are needed to these systems.

SUMMARY OF THE INVENTION

A wedge-shaped block of solid lubricant material is employed with this invention. Mounting means places the block into the wedge-shaped clearance located between the brake shoe pads and the wheel flange. In the preferred embodiment, the mounting means includes a metal support plate. This support plate is sandwiched between the brake shoe pads and the brake beam head which supports the brake shoes. The support plate has a cantilevered section that extends out toward the flange. The block of lubricant is secured to this cantilevered section to locate within the clearance.

In one embodiment, a spring means is employed for urging the block of lubricant continually into the clearance. The spring means comprises a resilient loop in the cantilevered section. In another embodiment, the cantilevered section is flat. In that case, the lubricant touches the flange only when the brakes are applied.

DETAILED DESCRIPTION OF THE INVENTION

Figure 1:
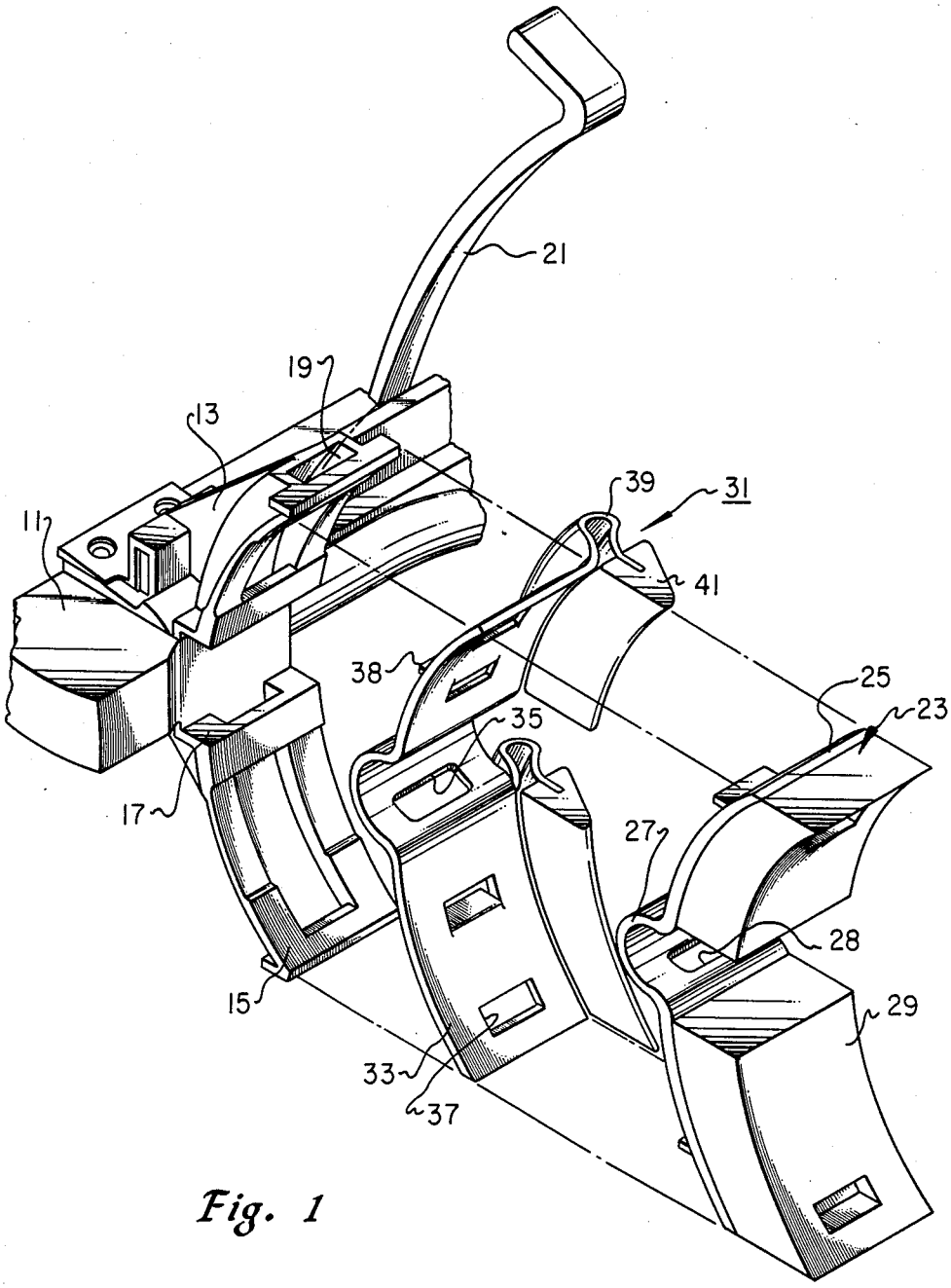
FIG. 1 is an exploded perspective view illustrating a portion of a braking system for a railroad vehicle and also including a wheel flange lubricant system constructed in accordance with this invention.

With reference FIG. 1, a portion of a railroad vehicle brake beam 11 is shown. Brake beam 11 is a conventional type for mounting brakes to a railroad car (not shown). Brake beam 11 extends between the trucks (not shown) and has two ends (only one shown), each having a beam head 13. The beam head 13 has two curved supports 15. A transverse cavity 17 is located between supports 15. A passage 19 extends through the supports 15. Passage 19 is adapted to receive a key 21.

Figure 4:
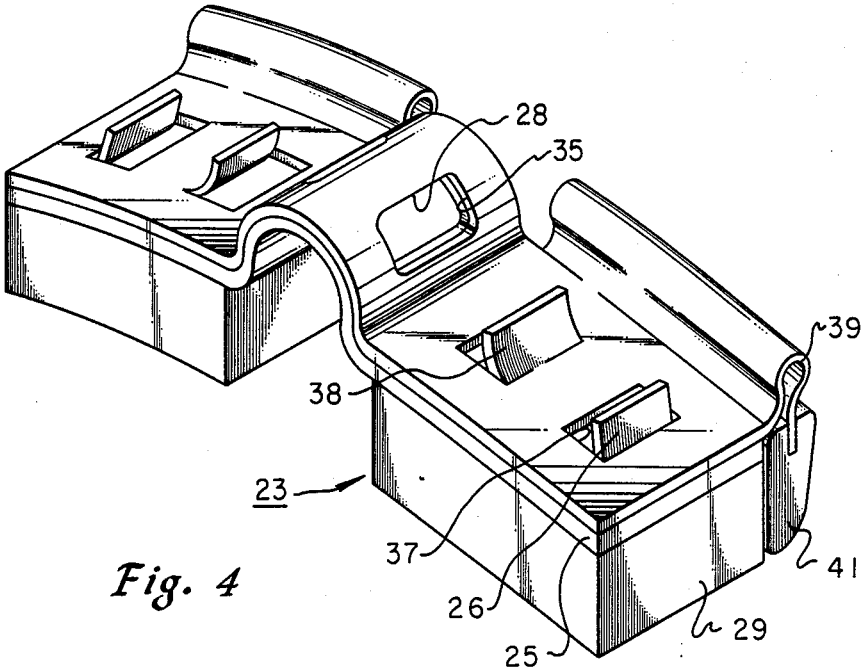
FIG. 4 is a perspective view showing the lubricant system of FIG. 1 installed on a brake shoe.

A brake shoe 23 mounts to each beam head 13. Each brake shoe 23 has a backing plate 25 that mates with the supports 15. As shown in FIG. 4, the backing plate 25 is a metal plate having lugs 26 that extend upward. Lugs 26 locate within slots in the supports 15 (FIG. 1). The backing plate 25 also has a curved locking section 27 that protrudes from the backing plate 25. The locking section 27 extends into the space between the two supports 15. The locking section 27 has a hole 28. Hole 28 aligns with the passage 19 for receiving the key 21.

Each brake shoe has two pads 29. Each pad 29 has a curved or arcuate face. Each pad 29 is spaced apart from the other by the length of the locking section 27. The pads 29 are of a conventional material. In conventional use, the brake shoe 23 is installed by inserting the locking section 27 into the cavity 17 between the supports 15, then inserting the key 21 through the holes 19 and 28 to retain the brake shoe 23.

A lubricating assembly 31 is adapted to be mounted to the brake shoe 23 and beam head 13. Lubricating assembly 31 has a metal support member or plate 33. Referring also to FIG. 4, the support plate 33 entirely overlies the backing plate 25, including the locking section 27. A central hole 35 in the support plate 33 aligns with the hole 28 (FIG. 1) in the locking section 27. Holes 37 are provided for receiving each of the lugs 26. Installation tabs 38 protrude from the support plate 33 to hold the brake shoe 23 in place during installation. The support plate 33 extends the full length of brake shoe 23 as well as the width.

A loop 39 is integral with and cantilevered from the support plate 33. Loop 39 extends outward from support plate 33, then curves back inward, terminating in a free edge alongside the brake shoe pad 29. There are two loops 39 on the support plate 33, each extending substantially the length of each pad 29 and spaced apart by the approximate distance between each of the pads 29. The metal of the support plate 33 and thus the loop 39 is sufficiently resilient to cause the loop 39 to act as a spring.

A block 41 of a solid lubricant material is bonded to the free edge of the loop 39. The free edge of loop 39 extends within the block 41. Block 41 may be made of various types of solid lubricant. Preferably, the material will contain graphite and molybdenum disulfide. Each block 41 extends approximately the same length as each pad 29. Also, the height of each block 41 is approximately the height of each pad 29.

Figure 2:
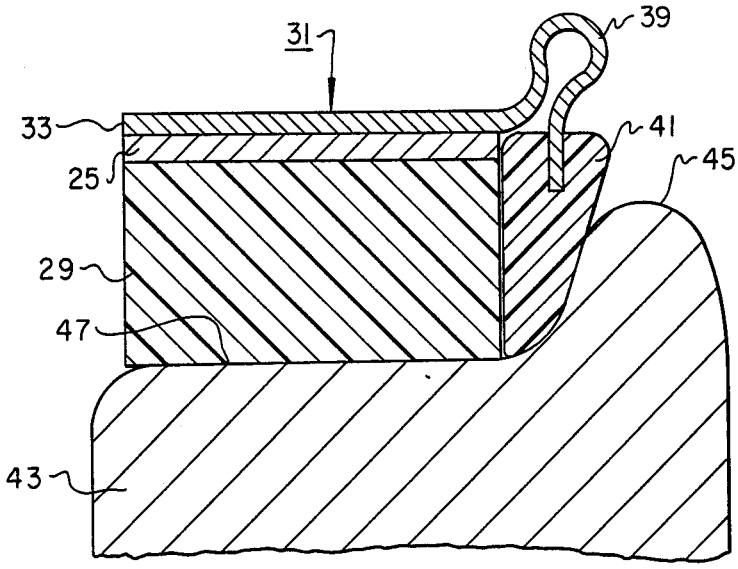
FIG. 2 is a vertical sectional view of a lubricant system as employed in FIG. 1.

Referring to FIG. 2, each block 41 is generally wedge-shaped in transverse cross-section. One side is vertical and contacts a side of the pad 29. The other side is tapered and curves gradually inward to a blunt crest at the inner end. The crest is located adjacent the face of the pad 29.

Figure 3:
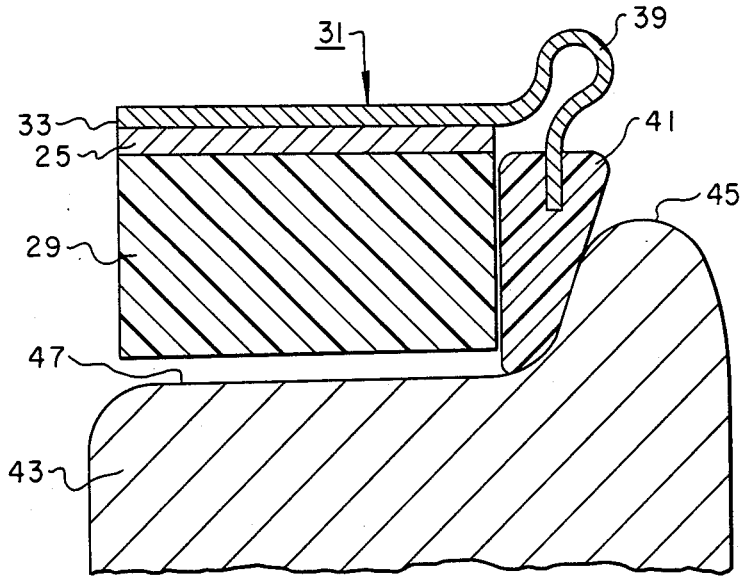
FIG. 3 is a vertical section view of the lubricant system of FIG. 2, but showing the brakes in a retracted position.
Figure 5:
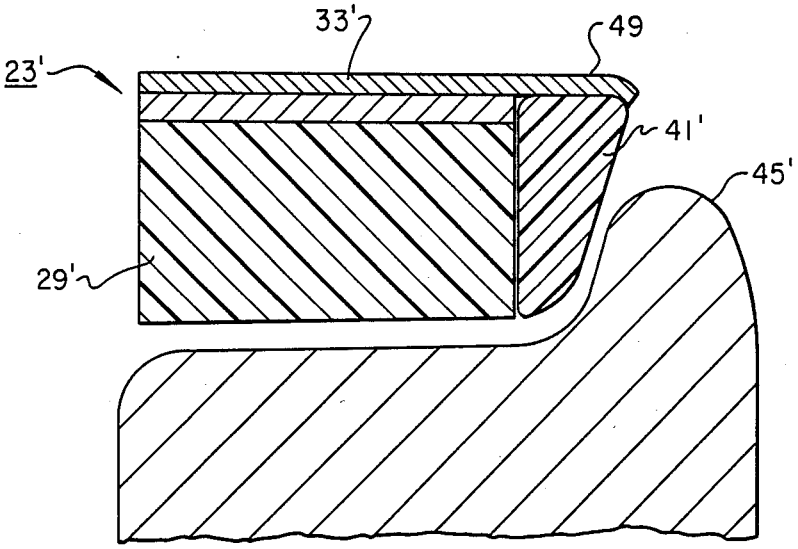
FIG. 5 is a vertical section view of an alternate embodiment of a lubricant system constructed in accordance of this invention.

In FIGS. 2, 3, and 5, the brake shoe 23 and lubricant assembly 31 are shown with a portion of a conventional wheel 43 for a railroad vehicle. Wheel 43 has a flange 45 that extends outward from a cylindrical tread 47. The words "outward" and "inward" used herein refer to directions along radial lines extending from the axis of the wheel 43. The tread 47 rolls on the rails (not shown), while the flange 45 retains the railroad vehicle on the rails. The flange 45 extends in an inclined curved surface from the junction with the tread 47. The brake shoe 23 and the flange 45 define a generally wedge shaped clearance between them.

In operation, the lubricant assembly 31 is installed by fastening the support plate 33 on the backing plate 25. This assembly is then placed in contact with the supports 15 of the beam head 13 (FIG. 1). The key 21 is inserted through the passage 19 and passages 28 and 35 (FIG. 4). The key 21 will retain the lubricant assembly 31 sandwiched between the beam head 13 and the brake shoe 23.

As the vehicle rolls along the track, the cantilevered loop 39 exerts a force radially inward toward the axle of the wheel 43, as shown in FIG. 2. This force urges the lubricant block 41 farther into the clearance between the flange 45 and brake shoe pad 29. The inclined side of the lubricant block 41 will rub against the flange 45 to continually apply lubricant.

As shown in FIG. 3, when the brake shoe 23 is retracted, the resiliency of the loop 39 continues to urge the lubricant block 41 into contact with the flange 45. When the brake shoe 23 is retracted, the crest of the lubricant block 41 will protrude past the face of the brake shoe pad 29, as shown in FIG. 3.

The type of material of the lubricant block 41 is selected so that it will last about as long as the brake shoe pads 29, which is normally about six months. As the brake shoe pads 29 wear, the lubricant block 41 will also wear. When it is time to exchange the brake shoe 23, a new lubricant assembly 31 will be installed or sooner if necessary.

In FIG. 5, an alternate embodiment is shown. Prime symbols are used to indicate the common components with the first embodiment. In this assembly, the lubricant block 41' is not urged inward by any spring means. Rather, the support plate 33' has a flat cantilevered section 49 that is not sufficiently resilient to operate as a spring. The inner edge or crest of lubricant block 41' initially coincides with the face of each pad 29', rather than protruding past. When the brake shoe 23' is retracted, as shown in FIG. 5, the lubricant block 41' will not be touching the flange 45'. The lubricant block 41' moves in unison with the brake shoe 23'. The lubricant block 41' touches the flange 45' and applies lubricant only when the brake shoe 23' is moved to the extended position when the brakes are applied. The lubricant block 41' is replaced in the same manner as in the first embodiment.

Figure 6:
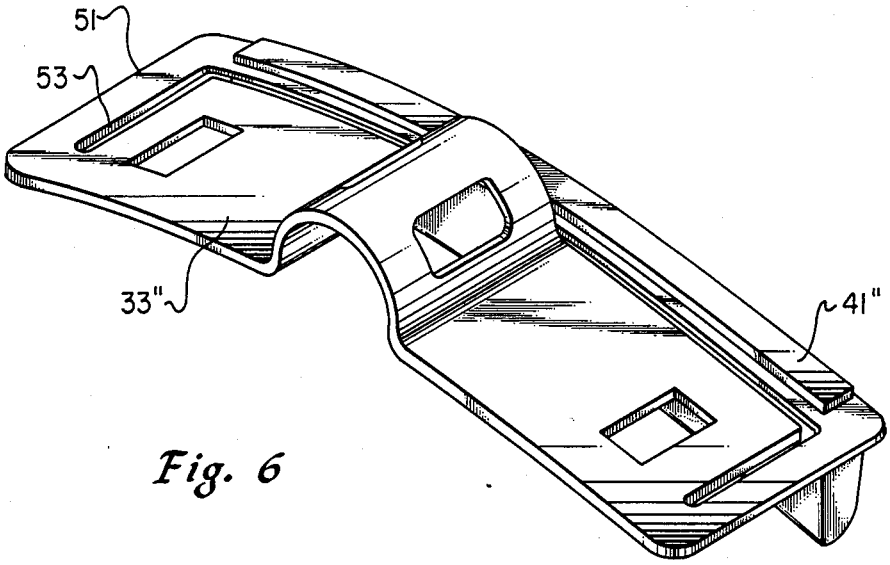
FIG. 6 is a perspective view of another alternate embodiment of a lubricant system constructed in accordance of this invention.
Figure 7:
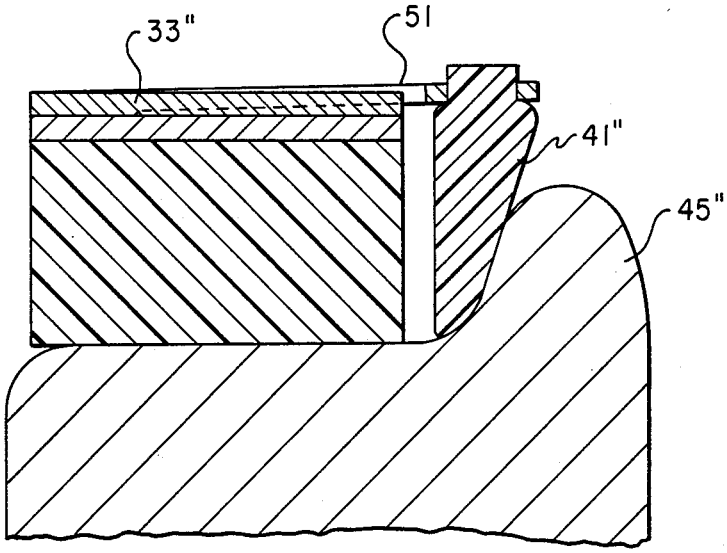
FIG. 7 is a vertical sectional view of the lubricant system of FIG. 6.

A second embodiment is shown in FIGS. 6 and 7. A double prime symbol is used to indicate components common with the other embodiments. The support plate 33'' has an arm 51 on each end. Each arm 51 is integrally formed with and cantilevered from the support plate 33''. The junction of each arm 51 is at the side of the support plate 33'' opposite the flange 45'' (FIG. 7). A slot 53 is located between each arm 51 and the end of the support plate 33''. Each slot 53 is parallel to the ends of the support plate 33''. Each arm 51 extends past the support plate 33''. The support plate 33'' and arm 51 are of a resilient metal.

A single wedge-shaped lubricant block 41'' is secured to the ends of the arms 51. The block 41'' extends substantially the full length of the support plate 33'' along the side of support plate 33'' that is next to the flange 45''. The height of the block 41'' is selected so that initially when contacting the flange 45'', the arms 51 will be deflected outward, as shown in FIG. 7. The resiliency in the arms 51 creates a spring force urging the block 41'' inward into contact with the flange 45''. As the block 41'' wears, the arms 51 will move inward, maintaining the block 41'' in contact with the flange 45''. The arms 51 maintain the block 41'' in contact with the flange 45'' whether the brake 29'' is retracted or extended. The support plate 33'' is installed in the same manner as the other embodiments.

The invention has significant advantages. Because of the simplicity and low cost of the device, it can be placed on all of the rail cars, not just a few of the vehicles of the train. Each car wheel flange is assured of lubrication. Being a solid lubricant, there is no chance of environmental damage as in the type that sprays on a liquid lubricant. The solid lubricant does not attract sand or dust. No maintenance is required, as the lubricant block is changed only when the brake shoes are changed under normal conditions. The lubricating assembly fits many types of brakes shoes for railroad vehicles.

While the invention has been shown in only three of its embodiments, it should be apparent to those skilled in the art, that it is not so limited but it susceptible to various changes without departing from the scope of the invention.

What is claimed is:

1. In a railroad vehicle having a plurality of wheels, each wheel having a cylindrical tread and a flange, the vehicle having a braking system with a brake shoe mounted for contact with the tread, an improved apparatus for applying lubricant to the flange, comprising in combination:

a support member having a first portion connected to the brake shoe and a second portion extending from the first portion; and a lubricant member mounted to the second portion in contact with the flange.

2. In a railroad vehicle having a plurality of wheels, each wheel having a cylindrical tread and a flange, the vehicle having a braking system with a brake shoe mounted for contact with the tread, an improved apparatus for applying lubricant to the flange, comprising in combination:

a support member having a first portion connected to the brake shoe and a second portion extending from the first portion;

a solid lubricant member mounted to the second portion; and the second portion further comprising spring means for applying a force to the lubricant member to urge the lubricant member into contact with the flange.

3. The apparatus according to claim 2 wherein the brake shoe has a pad with an arcuate face that is moved by the braking system between retracted and extended positions, wherein the first portion of the support member moves in unison with the pad, and wherein the spring means causes the lubricant member to remain in engagement with the flange while the pad is in the retracted and extended positions.

4. The apparatus according to claim 2 wherein the brake shoe has a backing plate, a pad mounted to the backing plate and adapted to contact the tread of the wheel, and wherein the first portion of the support member extends over the backing plate.

5. In a railroad vehicle having a plurality of wheels, each wheel having a cylindrical tread and a flange, the vehicle having a braking system with a brake beam having on each end a beam head to which is mounted a brake shoe, each brake shoe having a pad for contact with the tread, an improved apparatus for applying a lubricant to the flange, comprising in combination:

a support member having a first portion removably sandwiched between the beam head and the brake shoe and a second portion extending from the first portion; and a solid lubricant member secured to the second portion of the support member, the lubricant member extending into contact with the flange for applying lubricant to the flange.

6. The apparatus according to claim 5 wherein the second portion further comprises spring means for urging the lubricant member into contact with the flange.

7. In a railroad vehicle having a plurality of wheels, each wheel having a cylindrical tread and a flange, the vehicle having a braking system with a brake beam having on each end a beam head having an arcuate support containing a central cavity, a pair of aligned passages extending through the beam head perpendicular to the brake beam and intersecting the cavity, a brake shoe having a backing plate containing a central transverse locking section for reception in the cavity, a pair of aligned holes extending though the locking section for alignment with the passages, and a key inserted though the holes and passages to retain the brake shoe on the brake beam, an improved apparatus for applying a lubricant to the flange, comprising in combination:

a support member having a first portion disposed in the cavity between the beam head and the locking section, the first portion having a pair of aligned apertures which align with the holes in the locking section and the passages, the key passing through the apertures to retain the first portion between the beam head and the brake shoe, the support member having a second portion extending from the first portion;

a lubricant member secured to the second portion of the support member, the lubricant member extending into contact with the flange for applying lubricant to the flange; and the second portion further comprising spring means for urging the lubricant member continuously into contact with the flange.

8. A method of mounting a lubricating device to a railroad vehicle of the type having a plurality of wheels, each wheel having a cylindrical tread and a flange, the vehicle having a braking system with a brake beam having on each end a beam head having an arcuate support containing a central cavity, a pair of aligned passages extending through the beam head perpendicular to the brake beam and intersecting the cavity, a brake shoe having a backing plate containing a central transverse locking section for reception in the cavity, a pair of aligned holes extending though the locking section for alignment with the passages, and a key for insertion though the holes and passages to retain the brake shoe on the brake beam, the method comprising:

providing a support member with a first portion with a pair of aligned apertures and a second portion;

mounting a lubricant member to the second portion;

placing the first portion in the cavity in the beam head with the apertures in alignment with the passages in the beam head;

placing the locking section in contact with the first portion, with the holes in the locking section in alignment with the passages and the holes in the first portion; then inserting the key through the passages, holes and apertures to retain the first portion between the beam head and the brake shoe; and placing the lubricant member into contact with the flange for applying lubricant to the flange.

* * * * *